US006978748B2

(12) United States Patent
Diehl et al.

(10) Patent No.: US 6,978,748 B2
(45) Date of Patent: Dec. 27, 2005

(54) HYDRAULICALLY CONTROLLED ACTUATOR FOR ACTUATING GAS EXCHANGE VALVE ON THE EXHAUST SIDE OF AN INTERNAL COMBUSTION ENGINE

(75) Inventors: Udo Diehl, Stuttggart (DE); Bernd Rosenau, Tamm (DE); Uwe Hammer, Hemmingen (DE); Volker Beuche, Stuttgart (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/486,740

(22) PCT Filed: Jan. 31, 2003

(86) PCT No.: PCT/DE03/00273

§ 371 (c)(1),
(2), (4) Date: Jul. 27, 2004

(87) PCT Pub. No.: WO03/106820

PCT Pub. Date: Dec. 24, 2003

(65) Prior Publication Data

US 2004/0244741 A1 Dec. 9, 2004

(30) Foreign Application Priority Data

Jun. 13, 2002 (DE) ..... 102 26 254

(51) Int. Cl.[7] ..... F01L 9/02
(52) U.S. Cl. ..... 123/90.12; 123/90.24; 123/90.22; 123/90.23; 123/90.15; 123/90.65

(58) Field of Search ..... 123/90.12, 90.24

(56) References Cited

U.S. PATENT DOCUMENTS

| | | | | |
|---|---|---|---|---|
| 4,930,464 | A | 6/1990 | Letsche | |
| 5,531,192 | A * | 7/1996 | Feucht et al. | 123/90.12 |
| 5,673,658 | A | 10/1997 | Allmendinger | |
| 5,809,950 | A * | 9/1998 | Letsche et al. | 123/90.12 |
| 6,315,265 | B1 * | 11/2001 | Adler et al. | 251/28 |
| 6,701,879 | B2 * | 3/2004 | Diehl et al. | 123/90.22 |

FOREIGN PATENT DOCUMENTS

DE 198 26 047 12/1999

* cited by examiner

*Primary Examiner*—Thomas Denion
*Assistant Examiner*—Kyle M. Riddle
(74) *Attorney, Agent, or Firm*—Kenyon & Kenyon

(57) ABSTRACT

A hydraulically controlled actuator for actuation of an exhaust-side gas exchange valve of an internal combustion engine, containing a control piston that is displaceable within a cylinder and, with piston sides facing away from one another, delimits pressure chambers, of which the one pressure chamber impinges upon the gas exchange valve in the closing direction and the other pressure chamber impinges upon the gas exchange valve in the opening direction. In the actuator is provided at least one spring element, which can be brought into a preloaded state by the control piston moving in the closing direction of the gas exchange valve, and whose stored potential energy accelerates the gas exchange valve in the opening direction at least at the beginning of an opening phase, is provided. This results in a reduction in the energy expended in the context of valve actuation.

7 Claims, 1 Drawing Sheet

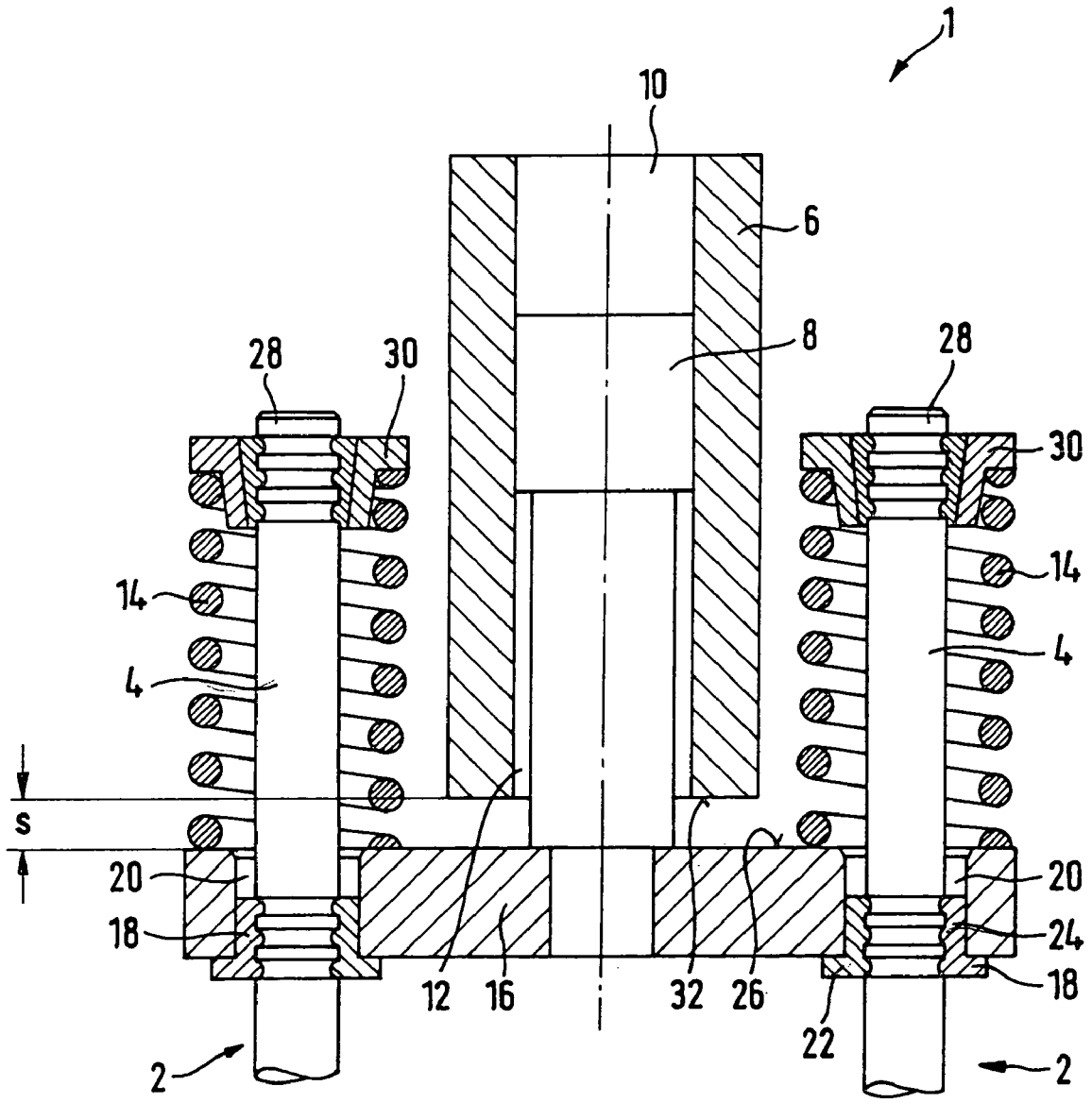
1
10
6
8
28
30
28
30
14
14
4
4
s
20
20
18
24
18
12
16
32
26
22
2
2

HYDRAULICALLY CONTROLLED ACTUATOR FOR ACTUATING GAS EXCHANGE VALVE ON THE EXHAUST SIDE OF AN INTERNAL COMBUSTION ENGINE

FIELD OF THE INVENTION

The present invention is based on a hydraulically controlled actuator for actuation of an exhaust-side gas exchange valve of an internal combustion engine, containing a control piston that is displaceable within a cylinder and, with piston sides facing away from one another, delimits pressure chambers, of which the one pressure chamber impinges upon the gas exchange valve in the closing direction and the other pressure chamber impinges upon the gas exchange valve in the opening direction.

BACKGROUND INFORMATION

An actuator of this kind is described in German Published Patent Application No. 198 26 047. When the gas exchange valves on the exhaust side of a cylinder of the internal combustion engine are still in the closed position at the beginning of the discharge stroke, they must work against a high internal cylinder pressure counteracting the hydraulic opening force. The internal cylinder pressure is high only when the gas exchange valves are in the closed state, however, whereas it drops rapidly after they open. A relatively high hydraulic opening pressure is consequently necessary only at the beginning of the opening phase, whereas a smaller opening force is sufficient once opening has already occurred and enlarged the flow cross section. The known actuator, however, always makes an opening force of identical magnitude available at the exhaust-side gas exchange valves, regardless of the particular requirement.

SUMMARY OF THE INVENTION

Based on the embodiment according to the present invention of the actuator, the potential energy stored by the spring element is used to generate an initially high actuator opening force so that the gas exchange valve can open quickly against the gas pressure in the cylinder. The spring element consequently generates, at the beginning of the opening phase of the gas exchange valve, an additional opening force acting in the same direction as the hydraulic opening force. As a result, the piston area of the control piston can be made smaller, or the pressure in the pressure chamber that acts in the opening direction can be reduced, resulting in an energy savings. Hydraulic force peaks are moreover reduced, resulting in an equalization of the hydraulic force being applied and consequently in lower flow losses; this also has a positive effect on the energy that must be made available by the internal combustion engine for the actuator.

It is particularly preferred if the spring element is connected mechanically in parallel with the control piston and, with the gas exchange valve still in the closed position, accelerates in the opening direction an entraining element, connected to the control piston, which strikes against a stop of the gas exchange valve. When the entraining element strikes the stop it already has a high level of kinetic energy, which it delivers to the gas exchange valve so that the latter's valve head is lifted off from the valve seating surface with a high acceleration.

The spring element is preferably braced under a preload between the entraining element and a shaft end of the shaft of the gas exchange valve. Since the gas exchange valve is then clamped by the spring element against both the entraining element and the control piston, a motion of the control piston in the closing direction can be transferred to the gas exchange valve.

The stop of the gas exchange valve is embodied in such a way that it comes out of engagement with the entraining element, which is moving in the closing direction, when the control piston is still continuing to be driven and the gas exchange valve is already completely closed. In this case the spring element is preloaded even further. In order to achieve a defined preload travel for the spring element and thus a defined acceleration of the gas exchange valve in the opening direction, an immovable stop, acting in the closing direction, for the entraining element is, for example, provided.

According to the preferred embodiment, the control piston simultaneously actuates two exhaust-side gas exchange valves of a cylinder, each of the two gas exchange valves having a spring element associated with it and the spring elements being constituted by two helical springs surrounding the shafts of the gas exchange valves. This results in a compact design for the actuator.

BRIEF DESCRIPTION OF THE DRAWING

The FIGURE is a schematic cross-sectional depiction of a preferred embodiment of an actuator according to the present invention for actuating two exhaust-side gas exchange valves.

DETAILED DESCRIPTION

The FIGURE is a schematic partially sectioned view of a hydraulically controlled actuator 1 for simultaneous actuation of two exhaust-side gas exchange valves 2 of an internal combustion engine, in accordance with a preferred embodiment. For reasons of scale, all that is depicted of each of the two gas exchange valves 2 is a valve shaft 4 at whose lower end is positioned a valve head which coacts with a valve seating surface configured in a cylinder head of the internal combustion engine in order to lift it off to a greater or lesser extent, by linear actuation of valve shaft 4, from the valve seating surface and expose a certain opening cross section. In the FIGURE, gas exchange valves 2 assume a position in which the valve heads are completely in contact against the associated valve seating surfaces (closed position of the gas exchange valves).

Hydraulically controlled actuator 1 has a control piston 8, retained in axially displaceable fashion in a cylinder 6 and acting on valve shafts 4, which subdivides cylinder 6 into two hydraulic pressure chambers delimited by it on end faces facing away from one another, namely an upper pressure chamber 10 and a lower pressure chamber 12. The two pressure chambers 10, 12 can be filled with hydraulic oil and are connected via pressure lines to a pressure supply device. The end surfaces of control piston 8 represent working surfaces for the hydraulic pressure present in pressure chambers 10, 12; pressure chamber 12 is preferably always under pressure and pressure chamber 10 is impinged upon preferably by the same pressure in order to open gas exchange valve 2 by way of the larger end surface of control piston 8 facing toward that pressure chamber 10, or to close it as a result of a pressure decrease in pressure chamber 10. The actuator is depicted in the FIGURE in the utilization position. Control piston 8 consequently moves downward (opening direction) in order to open gas exchange valves 2 or increase the opening cross section, or upward (closing direction) in order to close or decrease the opening cross section. The functional unit constituted by control piston 8 and cylinder 6 is preferably positioned between the two parallel valve shafts 4 of gas exchange valves 2. The operating principle of a hydraulically controlled actuator 1 of this kind is known, for example, from DE 198 26 047 A1, and therefore need not be discussed in further detail here.

In contrast to the document just cited, actuator 1 is configured in such a way that a large opening force is present at the beginning of the opening stroke of gas exchange valves 2, so that on the one hand the latter can open more quickly against the residual gas pressure in the cylinder of the internal combustion engine, and on the other hand a reduction occurs in the displacement force exerted by actuator 1 after that fraction of the overall travel, so that the energy consumption required for displacement of gas exchange valves 2 is reduced.

These requirements are met in the present case by the fact that at least one spring element 14, which is placed under a preload by control piston 8 moving in the closing direction of gas exchange valves 2 and which by relaxation exerts an additional opening force on gas exchange valve 2 at least at the beginning of an opening phase, is provided.

According to the preferred embodiment of the invention, two spring elements 14 are provided; they are disposed mechanically in parallel with control piston 8 and, with gas exchange valves 2 still in the closed position, accelerate in the opening direction an entraining element 16 which is connected to control piston 8 and which, after traveling over a preload distance s, strikes against stops 18 of gas exchange valves 2 and thereby abruptly opens them. The additional motion of control piston 8 directed in the opening direction is then also transferred to gas exchange valves 2 by stops 18 that are in engagement with entraining element 16.

The entraining element is made up, for example, of an entraining plate 16, positioned at an end of control piston 8 close to the combustion chamber, having two passthrough openings 20 through each of which passes a valve shaft 4 of a gas exchange valve 2, and against whose edges a respective step of a stepped bushing 18 can make contact. A larger-diameter part 22 of this bushing 18 on the combustion-chamber side extends radially beyond the edge of the associated passthrough opening 20, while a smaller-diameter part 24 of bushing 18, remote from the combustion chamber, is held in passthrough opening 20 in axially displaceable fashion with little clearance. Bushings 18, split in two along the center axis, are each secured on the associated valve shaft 4, preferably by way of mutually engaging annular protrusions and recesses. As is readily evident from the FIGURE, stop 18 acts only in the opening direction of gas exchange valve 2, while entraining plate 16 can come out of engagement with stop 18 as control piston 8 moves in the closing direction.

A motion of control piston 8 in the closing direction is therefore transferred to gas exchange valves 2 not by way of stop 18, but rather by way of the respective spring elements embodied as helical springs 14. One end of each helical spring 14 is braced against surface 26 of entraining plate 16 remote from the combustion chamber, and the other end against a shaft end 28 of valve shaft 4 of the respective gas exchange valve 2. A further stepped bushing 30, secured on shaft end 28, is provided for this purpose in each case. Helical springs 14 radially surround the portion of valve shafts 4 protruding through passthrough openings 20 of entraining plate 16. The axial spacing of the two bushings 18, 30 is selected in such a way that helical springs 14 are always under a preload even when stop bushings 18 are in engagement with entraining plate 16. The two helical springs 14 are moreover disposed mechanically in parallel with control piston 8.

Entraining plate 16 is pushed by the preload of the two helical springs 14 against the stops, constituted by bushings 18, of gas exchange valves 2 so that the latter are clamped against entraining plate 16. When control piston 8 is moved in the closing direction, this preload ensures that gas exchange valves 2 follow the upwardly directed motion of control piston 8. When gas exchange valves 2 are completely closed, however, they cannot perform any further upward motion, so that as control piston 8 moves farther in the closing direction, i.e. farther upward, entraining plate 16 comes out of engagement with bushings 18 and helical springs 14 are preloaded even further. An immovable stop for entraining plate 16, acting in the closing direction, limits preload travel s of the two helical springs 14 and is preferably constituted by an end surface 32, adjacent to the combustion chamber, of cylinder 6 that guides control piston 8; against that surface, surface 26 of entraining plate 16, remote from the combustion chamber, comes to rest. The distance traveled by entraining plate 16 between the position shown in the FIGURE, in which gas exchange valves 2 are in the closed position, and the position limited by stop 32, therefore corresponds to the additional preload travel s of helical springs 14.

When the upper working surface of control piston 8 is then impinged upon by pressure in order to open gas exchange valves 2, the potential energy stored in helical springs 14 ensures that in addition to the hydraulic opening forces, the spring forces resulting from preload travel s of helical springs 14 act on entraining plate 16. When entraining plate 16 then encounters stops 18 on the combustion-chamber side, it already has a high kinetic energy which it delivers to gas exchange valves 2, causing the latter's valve heads to be lifted off from the valve seating surfaces at a high acceleration.

What is claimed is:

1. A hydraulically controlled actuator for actuation of an exhaust-side gas exchange valve of an internal combustion engine, comprising:

a cylinder;

a control piston that is displaceable within the cylinder and, with piston sides facing away from one another, delimits a first pressure chamber and a second pressure chamber, wherein:

the first pressure chamber impinges upon the gas exchange valve in a closing direction, and the second pressure chamber impinges upon the gas exchange valve in an opening direction;

at least one spring element capable of being brought into a preloaded state by the control piston moving in the closing direction of the gas exchange valve, a stored potential energy of the at least one spring element being capable of accelerating the gas exchange valve in the opening direction at least at a beginning of an opening phase; and an entraining element connected to the control piston, wherein:

the at least one spring element is connected mechanically in parallel with the control piston and, with the gas exchange valve still in a closed position, accelerates in the opening direction an entraining element, the entraining element striking against a stop of the gas exchange valve;

a motion of the control piston in the closing direction can be transferred by the at least one spring element to the gas exchange valve;

the at least one spring element is braced under a preload between the entraining element and a shaft end of a first shaft of the gas exchange valve; and with the gas exchange valve completely closed, the at least one spring element can be even further preloaded by a motion of the control piston in the closing direction over a preload travel, the entraining element being configured such that during the motion, the entraining element comes out of engagement with the stop.

2. The actuator as defined in claim 1, further comprising:

an immovable stop, acting in the closing direction, for the entraining element and for limiting the preload travel of the at least one spring element.

3. The actuator as defined in claim 2, wherein:

the control piston simultaneously actuates the gas exchange valve and another gas-exchange valve of a cylinder of the internal combustion engine.

4. The actuator as defined in claim 3, wherein:

the at least one spring element includes a first spring element associated with the gas exchange valve and a second spring element associated with the other gas exchange valve.

5. The actuator as defined in claim 4, wherein:

the first spring element includes a first helical spring that surrounds the first shaft of the gas exchange valve, and the second spring element includes a second helical spring that surrounds a second shaft of the other gas exchange valve.

6. The actuator as defined in claim 5, further comprising:

a first bushing fastened on the first shaft; and a second bushing fastened on the second shaft, wherein:

the entraining element is disposed at an end of the control piston close to a combustion chamber and includes an entraining plate having two passthrough openings, the first shaft protrudes through a first one of the passthrough openings, the second shaft protrudes through a second one of the passthrough openings, a step of the first bushing makes contact with an edge of the first one of the passthrough openings, and a step of the second bushing makes contact with an edge of the second one of the passthrough openings.

7. The actuator as defined in claim 6, further comprising:

a first stepped bushing fastened on the shaft end of the first shaft and by which the first spring element is braced; and a second stepped bushing fastened on a shaft end of the second shaft and by which the second spring element is braced.

* * * * *